United States Patent [19]

Longenecker

[11] 4,055,011

[45] Oct. 25, 1977

[54] CALENDARS AND DISPLAY DEVICES

[76] Inventor: Lineaus W. Longenecker, R.D. 5, Manheim, Pa. 17545

[21] Appl. No.: 614,817

[22] Filed: Sept. 18, 1975

[51] Int. Cl.[2] ..... G09F 19/00

[52] U.S. Cl. ..... 40/124.1; 35/26; 35/53; 40/28 R

[58] Field of Search ..... 40/124.1, 158 R, 115, 40/137, 107, 119, 61 R, 104.02, 104.03, 115, 28, 53, 67; 35/13, 26, 27, 28, 42, 40, 53; 46/35–37; 283/2–4, 6, 61

[56] References Cited

U.S. PATENT DOCUMENTS

| | | | |
|---|---|---|---|
| 2,149,779 | 3/1939 | Kroner | 46/35 |
| 2,220,527 | 11/1940 | Kroner | 35/26 |
| 2,294,465 | 9/1942 | Lasker | 35/53 |
| 2,670,961 | 3/1954 | Winters | 46/37 |

OTHER PUBLICATIONS

"The Inside Story" Simmons, July 1947.

The World Book Encyclopedia, 1974, vol. 9, pp. 378–379.

Structure, 1941, General Electric Company.

*Primary Examiner*—E. H. Eickholt

*Attorney, Agent, or Firm*—Beveridge, DeGrandi, Kline & Lunsford

[57] ABSTRACT

A calendar has transparent overlay pages which carry opaque calendar data areas and opaque picture portions which are superimposed on an underlying picture, with the opaque picture portions depicting the underlying obscured portions at a different season of the year.

An overlay sheet with a transparent area is movable to positions where it overlies either a first base sheet or a second base sheet. An opaque picture portion in the transparent area is formed to be camouflaged when overlying one of the base sheets; and, the opaque picture portion presents a visible pictorial element when it overlies the other base sheet. An opaque area on the overlay sheet causes messages first to be concealed when the overlay sheet is in one position and then to be revealed when the overlay sheet is moved to its other position.

5 Claims, 10 Drawing Figures

FIG. 6
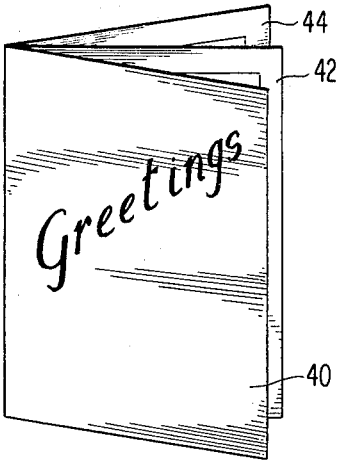
FIG. 7
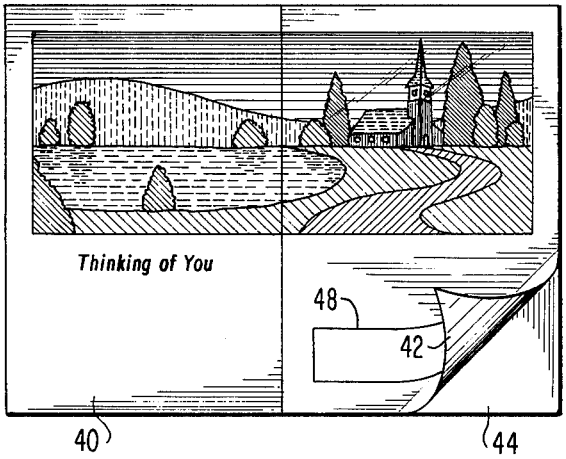
FIG. 8
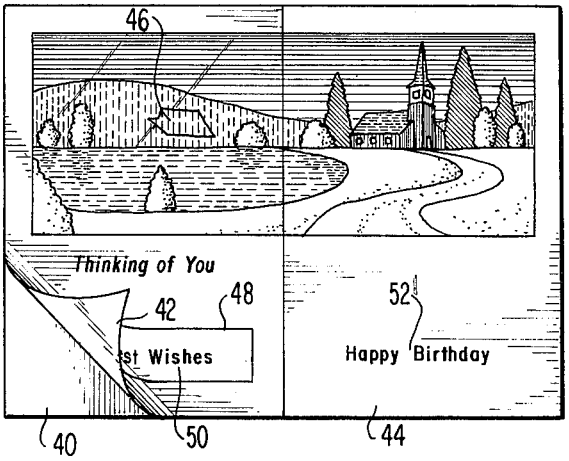
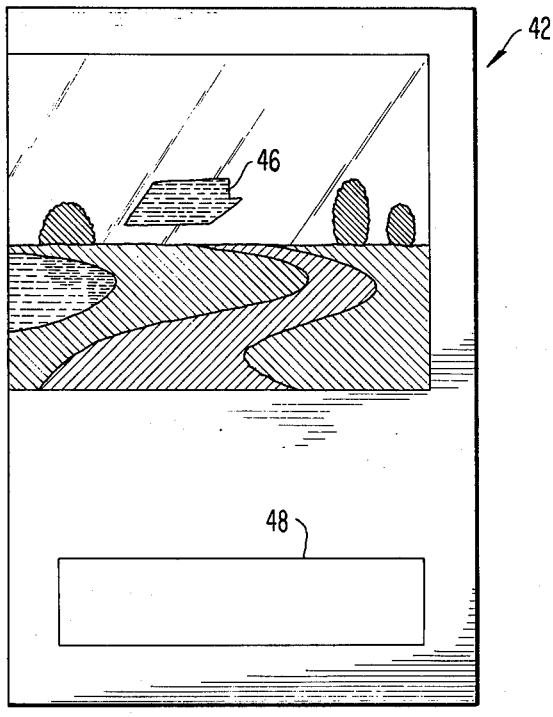
FIG. 9
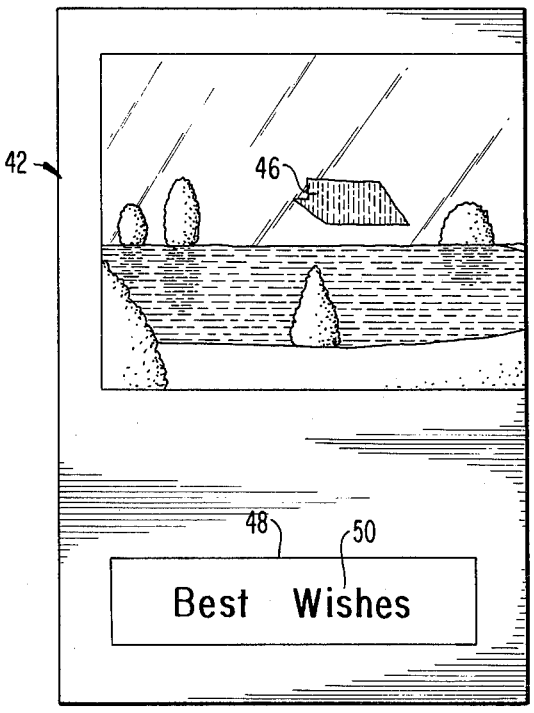
FIG. 10

CALENDARS AND DISPLAY DEVICES

BACKGROUND OF THE INVENTION

This invention relates to improved display devices provided with a pictorial representation which is changed by opaque picture portions in transparent overlay areas.

Pictorial calendars heretofore have been primarily of the type wherein a single picture is displayed throughout the year, or wherein a number of separate pages each bear their own complete picture. Unlike these previous calendars, one aspect of this invention is directed to a calendar wherein a single basic picture is displayed throughout the year, but certain portions thereof are changed during the course of the year, preferably to present an appearance corresponding to the time period represented by the uppermost calendar page.

There have been display devices which utilize transparent overlay sheets which bear picture portions representing snowcovered scenic elements, anatomical features or cutaway views of mechanical or physical objects. In some instances, these overlay sheets have borne different picture portions on their opposite sides which are material elements of objects depicted on opposite leaves of a book.

SUMMARY OF THE INVENTION

According to one aspect of this invention, a calendar is formed of a base sheet and a plurality of overlay sheets. The base sheet is provided with a picture and the overlay sheets are provided with a transparent area and picture portions which are adapted to overlie portions of the picture on the base sheet, thus forming a composite picture including elements both from the base picture and the picture portions of the overlay sheets.

The transparent overlay sheets and possibly the base sheet carry conventional calendar data areas which may be arranged on a weekly, monthly or quarterly basis. These calendar data areas on the transparent overlay sheets are positioned where they will be in register with each other, so that the placement of one transparent overlay sheet over the face of the calendar will obscure any previously-visible calendar data areas, while at the same time changing certain portions of the composite picture displayed by the calendar.

A further aspect of the invention pertains to display devices wherein an overlay sheet is movable between positions where it overlies two different base sheets, as when the overlay sheet is an intermediate page in a book, folder or greeting card. According to this aspect of the invention the opaque picture portion is camouflaged to blend into and provide no distinct outline when it overlies one of the base sheets. However, when overlying the other base sheet, the opaque picture portion adds a visible element to the underlying picture.

Still another feature of the invention relates to the combination of an overlay sheet bearing opaque picture portions with messages which are appropriately concealed and exposed by opaque and transparent portions of the overlay sheet. Specifically, a first message is located on a first base sheet and an opaque portion is located on an overlay sheet which is moved between positions where it overlies either the first base sheet or a second base sheet. A second message is located where it will be concealed when the overlay sheet is positioned over the second base sheet, whereby the second message cannot be viewed until the overlay sheet is removed from the second base sheet.

For a more complete understanding of the aspect of the invention, reference is made to the preferred embodiments thereof shown in the drawings and described in the following description.

DRAWINGS

Figure 5:
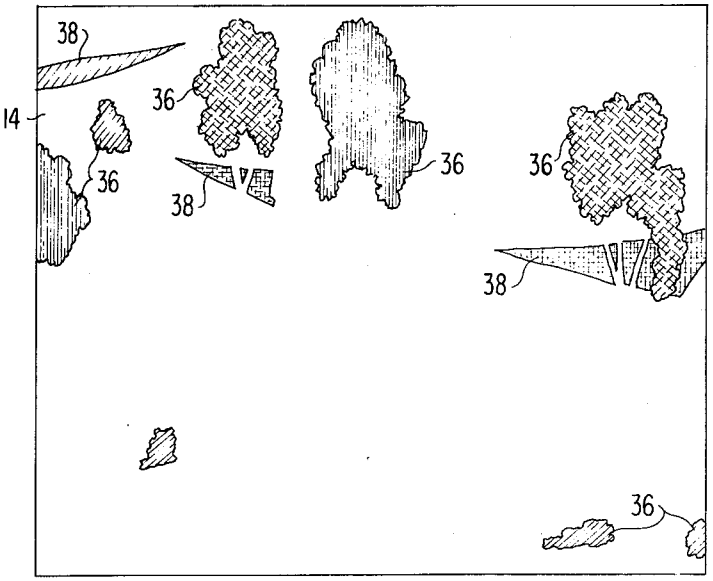
Figure 4:
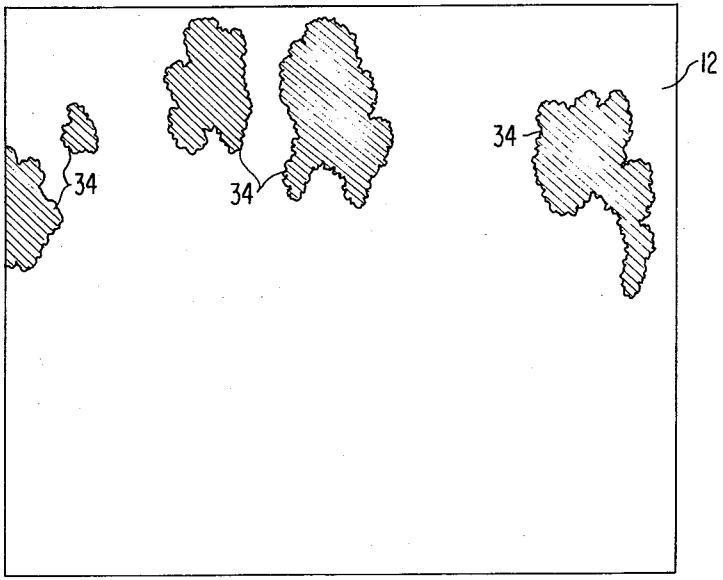

FIG. 4 and 5, respectively, show the picture portions of the third and fourth calendar overlay sheets which correspond to the summer and fall seasons of the year.

FIG. 6 shows a greeting card having two outer leaves and an intermediate leaf which has a transparent area with opaque picture portions.

FIG. 7 is an interior view of the greeting card of FIG. 6, with the intermediate leaf overlying the rear leaf.

FIG. 8 is a view similar to FIG. 7, but with the intermediate leaf overlying the front leaf.

FIGS. 9 and 10 are rear and front views, respectively, of the intermediate leaf of the device of FIGS. 6–8.

BRIEF DESCRIPTION

Figure 1:
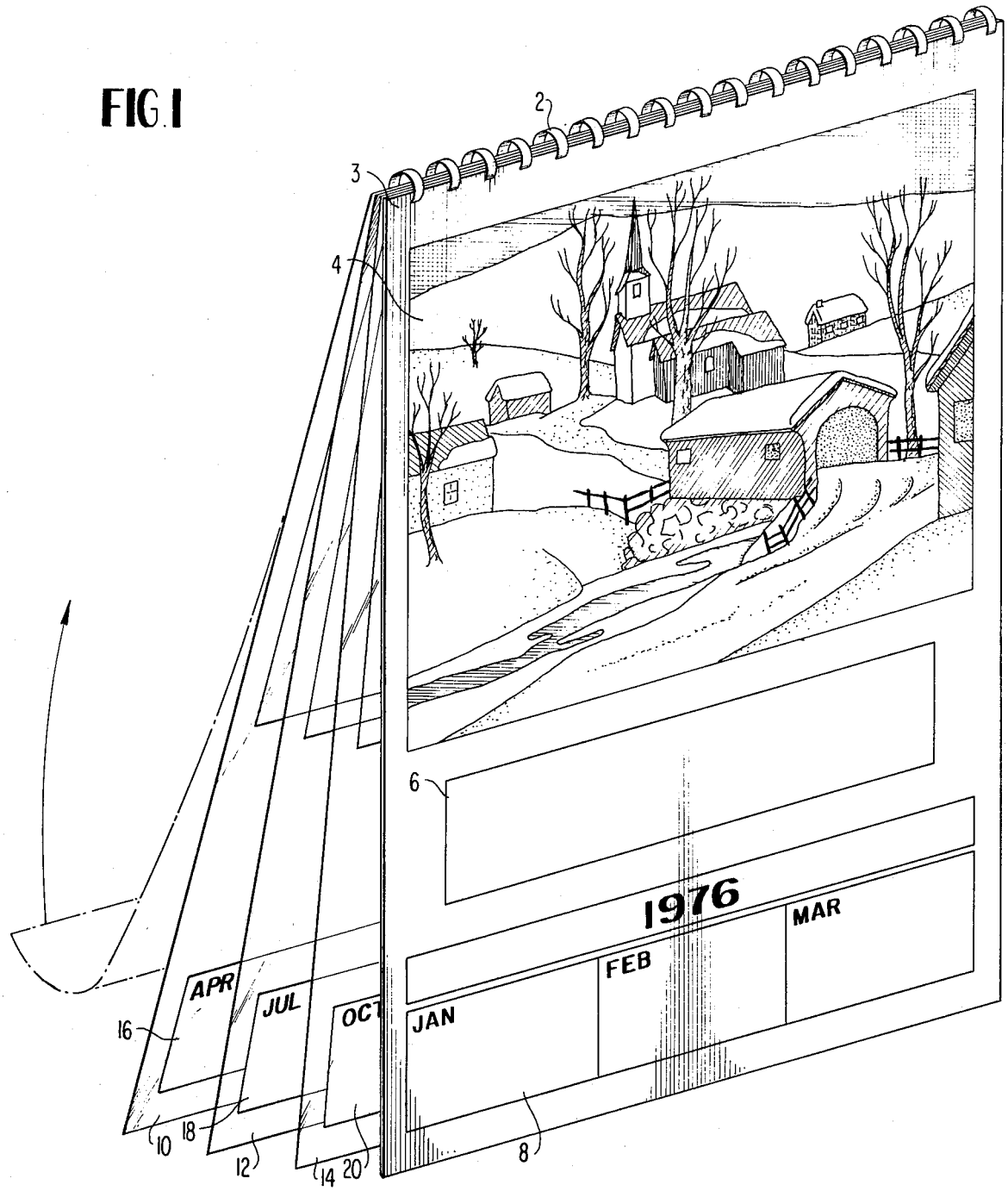
FIG. 1 is a perspective view of a calendar showing the base sheet and three transparent overlay sheets in their obscured position.

In FIG. 1, it will be seen that a calendar includes four sheets which are hingedly connected at their upper edge by a ring binder 2 or by folding, stapling or the like. The foremost sheet 3 is of cardboard or other semi-rigid material and is provided with a picture 4, an advertising-bearing area 6 and a calendar data area 8.

The illustrated picture 4 is a scenic view of a village landscape wherein the trees are barren of foliage and the ground and roofs of the building are covered with snow. This, of course, corresponds with the winter season represented in the calendar data area 8 which has calendar portions for the months of January, February and March. The days of the month are imprinted in the corresponding blocks, but they have been omitted for clarity of illustration.

The sheets 10, 12 and 14 are overlay sheets designed to be flipped forward to overlie the base sheet 3. They are provided with opaque calendar data areas 16, 18 and 20 which are positioned where they will register with and overlie any calendar data area therebeneath. Thus, as the overlay sheet 10 is placed in front of the base sheet 3, the calendar data area 16 for the months of April, May and June will obscure the calendar data area 8 for the months of January, February and March.

Figure 2:
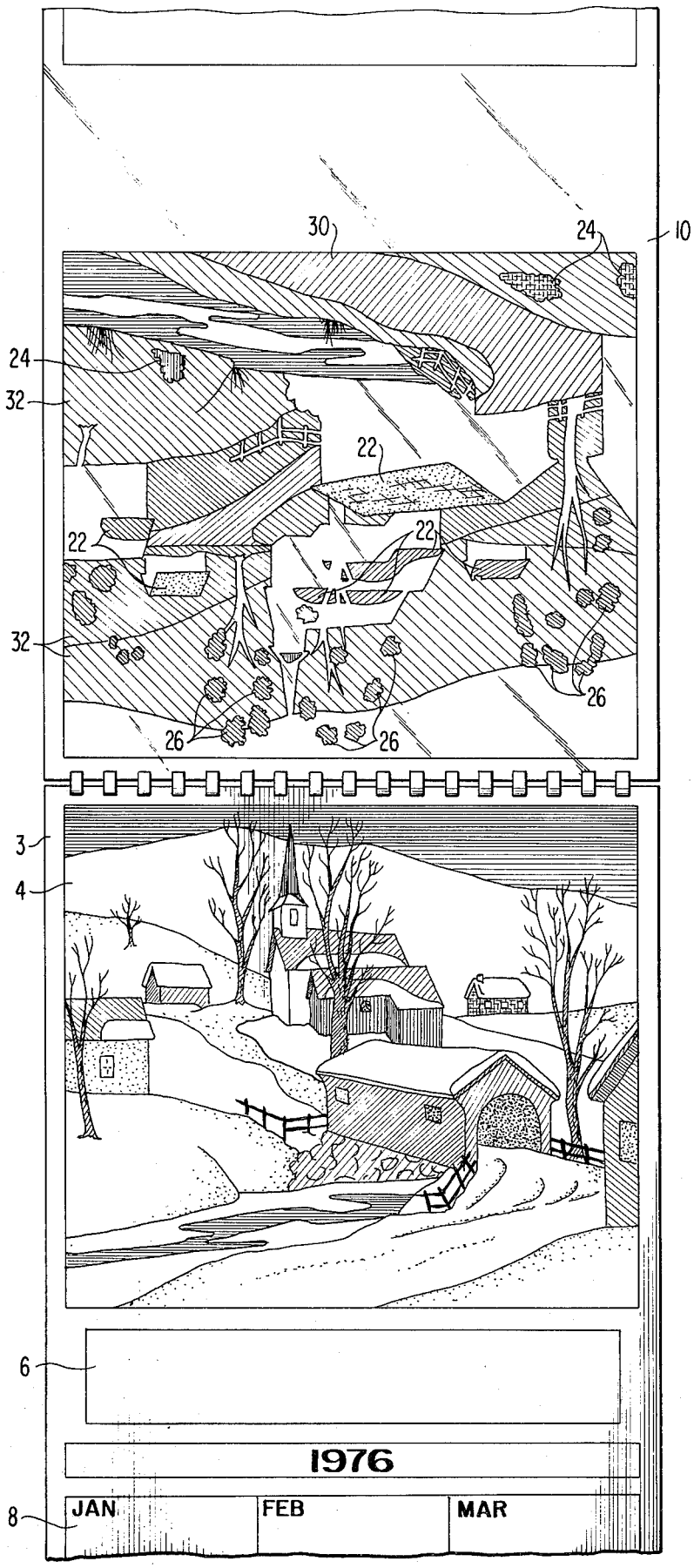
FIG. 2 shows the base sheet of the calendar of FIG. 1 and, in inverted form thereabove, the first overlay page which presents picture portions associated with the spring season of the year.

The overlay sheets 10, 12 and 14 are provided with transparent areas which carry picture portions which register with portions of the picture 4 on the base sheet 3. The content of these picture portions for the first overlay sheet 10 will be seen in FIG. 2 wherein roof segments 22 are provided to overlie the patches of snow seen in the picture 4, and spring foliage is added to the scene. The drawings are lined for color according to 37 CFR 3.61, indicating that brightly-colored flowered shubbery 24 has appeared on the scene, tufts of green foliage 26 appear at the tips of the tree branches. Roof picture portions 22, roadway picture portions 30 and field picture portions 32 are provided to obscure the previously-seen snow in the picture 4.

Figure 3:
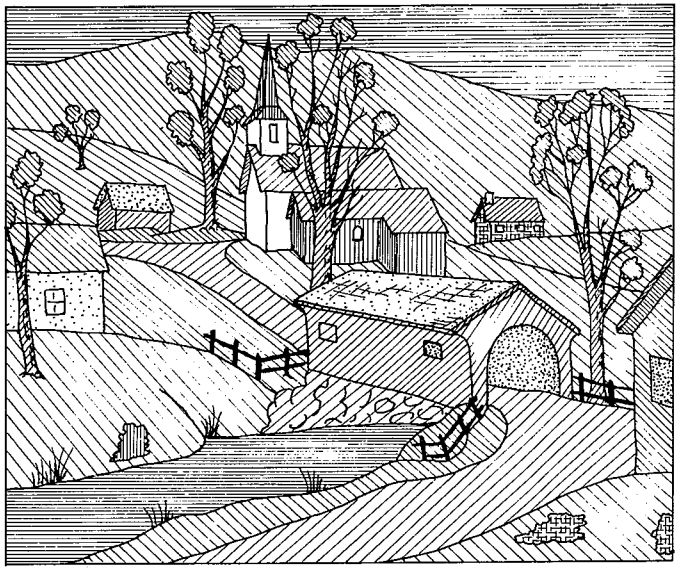
FIG. 3 shows the composite picture in the calendar of FIG. 1, formed by the first overlay sheet superimposed on the base picture.

FIG. 3 illustrates the appearance of the picture formed by the base picture 4 with the first overlay sheet 10 superimposed thereabove. Of course, when the composite picture appears in this form, the calendar data area will indicate the months of April, May and June, i.e. the months during which a landscape would have the appearance shown in the composite picture.

The transparent overlay 12 for the summer months of July, August and September is similar to FIG. 3, except that the trees have leafed out more fully, as will be seen from FIG. 4 which illustrates the enlarged green picture portions 34 added to the composite picture by this transparent overlay.

The fall season, typified by its colorful foliage, is associated with the third overlay sheet 14 which carries the calendar data areas for the months of October, November and December. As seen in FIG. 5, the picture portions 36 to be superimposed during this part of the calendar year include multicolored foliage, being indicated as brown, orange, yellow and red. Of course, many shades may be used. This scene also includes picture portions 38 which provide a change in color of the crops or grass growing in certain fields, making it more repesentative of this particular season of the year.

It has been observed that the use of multiple transparent overlay sheets will hang so as to provide a slight spacing between portions of adjacent sheets. This imparts a three-dimensional appearance to a landscape scene, making it very attractive both from the standpoint of the colors utilized and the general aesthetic appearance of the composite picture.

From the foregoing, it will be seen that this aspect of the invention presents a unique and attractive calendar wherein a given picture changes its characteristics to correspond with the time of year indicated by the calendar data areas which are visible. Of course, the uppermost overlay sheet may be the one bearing the winter picture portions and the winter calendar data area, so that seasonal changes are effected by removing rather than by adding overlay sheets. The picture may differ from the one illustrated and may be of objects other than landscapes, for example a human figure, with the overlay picture portions carrying different garments which preferably but not essentially are associated with the time of year shown on the associated calendar data areas. The year may be broken into seasons other than those indicated, perhaps on a monthly or weekly basis which would require a substantially larger number of overlay sheets. The overlay sheets may be made of transparent sheet material or they may be made of paper or other opaque materials, provided with windows which receive transparent acetate sheets bearing the picture portions.

The display device shown in FIGS. 6–10 is a greeting card, but many of its features are equally applicable to other articles such as books and calendars. The greeting card has a season-changing feature, and it may serve as a calendar simply by placing the appropriate calendar data areas on the leaves of the greeting card.

This greeting card is formed with a front leaf 40, an intermediate leaf 42 and a rear leaf 44. The intermediate leaf 42 is transparent and it is movable back-and-forth between the position shown in FIG. 7 where it overlies the picture on the rear leaf, and the position shown in FIG. 8 where it overlies the picture on the front leaf 40.

The composite picture displayed by this greeting card is a single scenic view or picture having a field, lake, hills, shrubs, trees and a church. The picture on the front leaf 40 is a summer scene with purple hills, blue water and green trees, shrubs and fields. Of course this may instead show the bright colors and vegetation of the spring or fall seasons. This same seasonal motif appears in the picture portions displayed by the front face of the intermediate leaf 42, which also has an opaque roof portion 46 which registers with and obscures the church roof portion on the underlying picture on the rear leaf 44.

The roof and other picture portions on the rear leaf 44 are typical of such a scene in winter, with ice and snow covering the lake, field, shrubs and roof. Like colors are used on the rear face of the intermediate sheet, wherein opaque picture portions are located where they will overlie and change the seasonal appearance of picture elements on the front leaf 40. The church roof picture portion 46, however, is colored on its rear face to match the background hills, so that the roof picture portion 46 is camouflaged against the purple hills and does not provide a distinct outline. In display devices which have alphanumeric material, as in a book, this camouflage effect may be achieved by printing such characters and/or their background colors on one side of the camouflaged opaque picture portions. In some instances, there may be more than one transparent intermediate leaf, the content of which may be camouflaged against the underlying material.

In FIGS. 7–10, a first message on the first base sheet 40 is designated 46. The overlay sheet 42 is provided with an opaque area 48. One second message 50 is located on the rear face of the overlay sheet 42 in alignment with the opaque area 48. Another second message 52 is located on the second base sheet.

It will be apparent that a person receiving the greeting card of FIGS. 8–10 will first open it to see only the first message 46, as the messages 50 and 52 are concealed by the opaque area 48. Upon turning the overlay sheet to the position shown in FIG. 8, both of the messages 50 and 52 will be visible. If the overlay sheet is made of transparent material or is provided with a cutout to provide transparency, the first message 46 will continue to be visible.

Many variations of this feature will be apparent. Two or more overlay sheets may be provided, each one bearing additional message material on its rear face, for example the verses of a poem. Overlay sheets may be formed of opaque material if desired, in which event cutouts are located in the area requiring transparency.

Those skilled in the art will realize that the invention may take many forms other than the preferred embodiments and the alternative embodiments described above. These principles are applicable to framed pictures, calendars, books, greeting cards and other display devices of a pictorial nature. Therefore, it is emphasized that the invention is not limited only to the disclosed embodiments, but it is encompassing of all subject matter within the spirit of the claims which follow.

I claim:

1. A display device, comprising, a first base sheet provided with a picture thereon, a second base sheet provided with a picture thereon, an overlay sheet having a transparent area movable from a first position where one face thereof confronts and overlies the first base sheet to a second position where the opposite face thereof confronts and overlies the second base sheet, said overlay sheet having an opaque picture portion which registers with and obscures underlying areas of said base sheets, said opaque picture portion having a first surface which is exposed and visible when the overlay sheet is in its first position, said first surface being camouflaged to blend into and add no distinct pictorial element or outline to the picture on the first base sheet when the overlay sheet is in its first position, said opaque picture portion having a second surface which is exposed and visible when the overlay sheet is in its second position, said second surface presenting a visible pictorial element which adds to the picture on the second base sheet when the overlay sheet is in its second position over said second base sheet.

2. The display device of claim 1 wherein the base sheets together depict a single scenic view, and movement of the overlay sheet from its first position to its second position produces a change of the season of the year in said scenic view.

3. The display device of claim 1 in which the picture on the first base sheet and the picture on the second base sheet together form a single scenic view.

4. The display device of claim 1 wherein the marginal portions of the first surface of the opaque picture portion are colored the same as the areas of the first base sheet which are immediately adjacent to said marginal portions.

5. The display device of claim 4 in which the picture on the first base sheet and the picture on the second base sheet together form a single scenic view.

* * * * *